US009802745B2

(12) United States Patent
Perell et al.

(10) Patent No.: US 9,802,745 B2
(45) Date of Patent: Oct. 31, 2017

(54) POUR CHANNEL WITH COHESIVE CLOSURE VALVE AND LOCKING BUBBLE

(75) Inventors: William S. Perell, San Francisco, CA (US); Leif B. Sorensen, Cape Canaveral, FL (US)

(73) Assignee: Poppack LLC, San Francisco, CA (US)

( * ) Notice: Subject to any disclaimer, the term of this patent is extended or adjusted under 35 U.S.C. 154(b) by 583 days.

(21) Appl. No.: 12/811,455

(22) PCT Filed: Sep. 2, 2008

(86) PCT No.: PCT/US2008/075011

§ 371 (c)(1),
(2), (4) Date: Sep. 1, 2010

(87) PCT Pub. No.: WO2009/088537

PCT Pub. Date: Jul. 16, 2009

(65) Prior Publication Data

US 2010/0326989 A1 Dec. 30, 2010

Related U.S. Application Data

(63) Continuation-in-part of application No. 11/713,114, filed on Mar. 2, 2007.

(Continued)

(51) Int. Cl.
*B65D 75/00* (2006.01)
*B65D 75/58* (2006.01)

(52) U.S. Cl.
CPC ..... *B65D 75/5861* (2013.01); *B65D 75/5866* (2013.01); *B65D 2575/586* (2013.01)

(58) Field of Classification Search
CPC ..... B29C 65/00; B29C 66/8122; B65D 75/30; B65D 75/5822; B65D 75/5855;
(Continued)

(56) References Cited

U.S. PATENT DOCUMENTS 2,916,886 A 12/1959 Robbins
3,074,544 A 1/1963 Bollmeier et al.
(Continued)

FOREIGN PATENT DOCUMENTS

DE 20314741 1/2004
EP 00306207 A1 3/1989
(Continued)

OTHER PUBLICATIONS

U.S. Appl. No. 12/434,254, filed May 1, 2009, Package with one or More Access Points for Breaking one or more Seals and Accessing the Contents of the Package.

(Continued)

*Primary Examiner* — Peter Helvey
(74) *Attorney, Agent, or Firm* — Dority & Manning, P.A.

(57) ABSTRACT

A container for dispensing various compositions includes a pourable spout located within a breachable bubble. In one embodiment, for instance, the container can be made from flexible polymer films. The container can include a sealed perimeter that defines an opening where a pourable spout is located. A locking bubble can be located over the opening for preventing liquids from being dispensed from the container prior to opening the bubble. When it is desired to dispense the container, the bubble can be breached which therefore allows the contents of the container to be dispensed through the opening.

18 Claims, 8 Drawing Sheets

Related U.S. Application Data

(60) Provisional application No. 61/010,408, filed on Jan. 9, 2008, provisional application No. 61/046,667, filed on Apr. 21, 2008.

(58) Field of Classification Search
CPC ..... B65D 75/5861; B65D 75/5866; B65D 75/2575; B65D 75/586
USPC .... 383/210, 210.1, 211, 78, 80–81; 220/265
See application file for complete search history.

(56) References Cited

U.S. PATENT DOCUMENTS 3,120,336 A 2/1964 Whatley, Jr.
3,189,227 A 6/1965 Hobbs et al.
3,256,981 A 6/1966 Kurtz
3,294,227 A 12/1966 Schneider et al.
3,301,390 A 1/1967 Via, Jr.
3,342,326 A 9/1967 Zackheim
3,419,137 A 12/1968 Walck, III
3,478,871 A 11/1969 Sager
3,521,805 A * 7/1970 Ward ..... 206/539
3,573,069 A 3/1971 Keller et al.
3,608,709 A 9/1971 Pike
3,635,376 A 1/1972 Hellstrom
3,847,279 A 11/1974 Montgomery
3,921,805 A 11/1975 Compere
3,964,604 A 6/1976 Prenntzell
4,275,840 A 6/1981 Staar
4,301,923 A 11/1981 Vuorento
4,402,402 A 9/1983 Pike
4,485,920 A 12/1984 Skylvik
4,511,052 A 4/1985 Klein et al.
D279,808 S 7/1985 Pharo
4,540,089 A 9/1985 Maloney
4,597,244 A 7/1986 Pharo
4,610,684 A 9/1986 Knox et al.
4,632,244 A 12/1986 Landau
4,704,314 A 11/1987 Hsu et al.
4,708,167 A * 11/1987 Koyanagi ..... 137/512.15
4,711,359 A 12/1987 White et al.
4,759,472 A 7/1988 Strenger
4,793,123 A 12/1988 Pharo
4,798,288 A 1/1989 Holzner
4,872,556 A 10/1989 Farmer
4,872,558 A 10/1989 Pharo
4,874,093 A 10/1989 Pharo
4,890,744 A 1/1990 Lane, Jr. et al.
4,918,904 A 4/1990 Pharo
4,949,530 A 8/1990 Pharo
4,961,495 A 10/1990 Yoshida et al.
5,050,736 A 9/1991 Griesbach
5,100,028 A 3/1992 Seifert
5,114,004 A 5/1992 Isono et al.
5,126,070 A 6/1992 Leifheit et al.
5,131,760 A 7/1992 Farmer
5,137,154 A 8/1992 Cohen
5,195,658 A * 3/1993 Hoshino ..... 222/92
5,207,320 A 5/1993 Allen
5,215,221 A 6/1993 Dirksing
5,263,609 A * 11/1993 Hoshino ..... 222/92
5,272,856 A 12/1993 Pharo
D347,993 S * 6/1994 Lane et al. ..... D9/707
5,325,968 A 7/1994 Sowden
5,373,966 A 12/1994 O'Reilly et al.
5,427,830 A 6/1995 Pharo
5,445,274 A 8/1995 Pharo
5,447,235 A 9/1995 Pharo
5,487,470 A 1/1996 Pharo
5,492,219 A 2/1996 Stupar
5,564,591 A 10/1996 Christine et al.
5,588,532 A 12/1996 Pharo
D386,074 S 11/1997 Pharo
5,701,996 A * 12/1997 Goto et al. ..... 206/287
5,711,691 A 1/1998 Damask et al.
5,775,491 A 7/1998 Taniyama
5,792,213 A 8/1998 Bowen
5,814,159 A 9/1998 Paley et al.
5,824,392 A 10/1998 Gotoh
5,865,309 A 2/1999 Futagawa et al.
5,870,884 A 2/1999 Pike
5,910,138 A 6/1999 Sperko et al.
5,928,213 A 7/1999 Barney et al.
5,944,709 A 8/1999 Barney et al.
5,967,308 A 10/1999 Bowen
6,001,187 A 12/1999 Paley et al.
6,007,264 A 12/1999 Koptis
6,036,004 A 3/2000 Bowen
6,068,820 A 5/2000 De Guzman
6,165,161 A 12/2000 York et al.
6,198,106 B1 3/2001 Barney et al.
6,203,535 B1 3/2001 Barney et al.
6,293,394 B1 * 9/2001 Marbler et al. ..... 206/218
6,391,353 B1 * 5/2002 Marbler et al. ..... 426/115
6,468,377 B1 10/2002 Sperko et al.
6,491,159 B2 12/2002 Shibata
6,547,468 B2 4/2003 Gruenbacher et al.
6,658,400 B2 12/2003 Perell et al.
6,692,150 B2 2/2004 Hoshino
6,726,364 B2 4/2004 Perell
6,846,305 B2 1/2005 Smith et al.
6,935,492 B1 8/2005 Loeb
6,938,394 B2 9/2005 Perell
6,968,952 B2 11/2005 Crevier et al.
6,996,951 B2 2/2006 Smith et al.
7,004,354 B2 2/2006 Harper
7,040,483 B2 * 5/2006 Inuzuka et al. ..... 206/219
7,051,879 B2 5/2006 Ramet
7,055,683 B2 6/2006 Bourque et al.
7,175,614 B2 2/2007 Gollier et al.
7,306,095 B1 12/2007 Bourque et al.
7,306,371 B2 12/2007 Perell
7,597,691 B2 10/2009 Kawaguchi et al.
7,644,821 B2 1/2010 Perell
7,866,886 B2 * 1/2011 Kurosawa et al. ..... 383/44
2002/0150658 A1 10/2002 Morrissette et al.
2002/0170832 A1 11/2002 Klair
2003/0019781 A1 1/2003 Kocher
2003/0102229 A1 * 6/2003 Inuzuka et al. ..... 206/219
2004/0057638 A1 * 3/2004 Perell et al. ..... 383/210
2004/0226848 A1 11/2004 Dunn-Rankin
2006/0023976 A1 2/2006 Alvater et al.
2006/0126970 A1 * 6/2006 Perell ..... 383/61.1
2007/0235369 A1 10/2007 Perell
2007/0237431 A1 10/2007 Perell
2007/0284375 A1 12/2007 Perell
2007/0286535 A1 12/2007 Perell
2007/0295766 A1 12/2007 Perell
2008/0212904 A1 9/2008 Perell
2009/0179036 A1 * 7/2009 Seelhofer ..... 220/705
2010/0300901 A1 * 12/2010 Perell et al. ..... 206/205
2011/0200275 A1 * 8/2011 Perell et al. ..... 383/210.1
2013/0118134 A1 5/2013 Perell et al.

FOREIGN PATENT DOCUMENTS

EP 00317130 A1 5/1989
EP 0709302 A1 5/1996
FR 2345363 A1 10/1977
GB 2253605 A 9/1992
JP 04215927 A 8/1992
JP 7/8236 7/1995
JP 2003146364 5/1996
JP 11029176 A 2/1999
JP 200255598 A 9/2000
JP 2002503187 1/2002
JP 2002037327 2/2002
WO WO 96/23700 A1 8/1996
WO WO 02/083504 A1 10/2002
WO WO 2004/100856 A2 11/2004
WO WO 2005/022323 A 3/2005
WO WO 2005/077811 A1 8/2005

(56) References Cited

FOREIGN PATENT DOCUMENTS

| | | | |
|---|---|---|---|
| WO | WO2009/086344 | A1 | 7/2009 |
| WO | WO2009/086346 | A1 | 7/2009 |
| WO | WO2009/088759 | A1 | 7/2009 |

OTHER PUBLICATIONS

U.S. Appl. No. 12/704,914, filed Feb. 12, 2010, entitled Package Containing a Breachable Bubble in Combination with a Closure Device.
U.S. Appl. No. 12/703,947, filed Feb. 11, 2010, entitled Package with Unique Opening Device and Process for Forming Package.
U.S. Appl. No. 12/811,455, filed Jul. 1, 2010, entitled Pour Channel with Cohesive Closure Valve and Locking Bubble.

* cited by examiner

POUR CHANNEL WITH COHESIVE CLOSURE VALVE AND LOCKING BUBBLE

RELATED APPLICATIONS

The present application is a continuation-in-part application of U.S. patent application Ser. No. 11/713,114, filed Mar. 2, 2007; and the present application is based on and claims priority to U.S. Provisional Patent Application No. 61/010,408, filed Jan. 9, 2008 and U.S. Provisional Patent Application No. 61/046,667, filed Apr. 21, 2008.

BACKGROUND

Currently, many liquid products are packaged in flexible containers. The flexible containers, for instance, can be made from one or more layers of polymer film. The liquid products typically packaged in such containers include, for instance, beverages, such as fruit-flavored drinks, liquid soaps and detergents, hair care products, sunscreen compositions, and the like. Such containers may be less expensive than many aluminum cans and bottles. The flexible containers are also easy to package and ship.

Unfortunately, many of the above described flexible containers produced in the past have been somewhat difficult to open. These types of containers are especially difficult to open for young children, the elderly, or those that suffer from hand ailments, such as arthritis.

Another problem with such previously made containers is that it is typically difficult to dispense the liquid in a controlled manner. These containers, for instance, are opened by tearing the top off the container, tearing a corner or inserting a straw into the container. Since the packages are flexible, the containers are prone to spill their contents, especially when any type of pressure is applied to the container.

In view of the above, the present disclosure is generally directed to an improved container that is relatively easy to open and has a built-in pour channel for dispensing compositions from the container in a controlled manner. Although the teachings of the present disclosure are well suited for incorporation into flexible containers, it should be understood that the present disclosure is also directed to the construction of rigid containers.

SUMMARY

In general, the present disclosure is directed to a container for holding and dispensing compositions. The container, for instance, can hold liquid products, solid products such as powders or granules, or semi-solid products such as gels and pastes.

In one embodiment, the container includes a housing defining a hollow interior volume. A pour spout or pour channel is in communication with the interior volume of the housing and is configured to dispense the contents of the housing from the container.

In accordance with the present disclosure, the container further includes a locking bubble that surrounds at least a portion of the pour channel. The locking bubble is surrounded by a bubble seal. The bubble seal prevents the contents of the container housing from exiting the container through the pour channel. The locking bubble, however, is breachable when subjected to sufficient pressure. For instance, a user can breach the bubble by squeezing the bubble between one's fingers. When the bubble is breached, the contents of the container housing can be dispensed through the pour channel.

The container made in accordance with the present disclosure can be a rigid container or can be a flexible container, such as a pouch. When a flexible container is used, for instance, the container can be made from a polymer film. In one particular embodiment, the pour channel and the locking bubble can be integral with the container housing.

As described above, the locking bubble is surrounded by a bubble seal. In one embodiment, the bubble seal can include a breaching point comprising a weakened portion of the seal. When pressure is applied to the locking bubble, the locking bubble breaches at the breaching point. The breaching point is located so as to enable the pour channel.

In one embodiment, the container housing may define a perimeter. The pour channel may comprise a channel that projects from the perimeter. The sides of the channel may normally be in a flat-closed state forming a closure valve. The consumer may distort the flat sides into a bowed open state by squeezing the filled or (partially filled) container. The bowed sides create a pour opening in the pour channel into the ambient. The containers are preferably flexible receptacles which may be stored resting in an upright vertical position or in a horizontal position. Rigid containers may also be employed. The internal pressure generated by the consumer squeeze pushes the flat sides of the pour channel apart to open the closure valve, and the product may be poured out as required.

After each use, the consumer may close the closure valve by pressing the bowed sides of the pour channel together into the flat closed state. The valve remains closed by mutual cohesive attraction between the flat side surfaces.

Liquid content of the container may wet the flat surfaces of the channel and contribute adhesion attraction to the closure force.

The pour channel may have a one-way valve in the forward pour direction. The flow valve permits product flow out of the container and prevents reverse flow of ambient air into the container carrying ambient contamination. Because of the one-way valve, the volume of the container progressively decreases with use.

During shipping and shelf display, the pour channel may be locked closed by an external locking bubble, which firmly presses against the channel, urging the flat sides together. The opposed portions of the locking bubble may be conveniently formed by a fold along the top of the container. Other ways of forming the locking bubble are also possible. A vacuum pull may be employed to draw the folded lamina apart into opposed semi-spherical or semi-cylindrical shaped bubbles. The fold may be pressed into sealing engagement around the edges to trap ambient air within the bubble. The strength of the engagement is determined by varying the time-temperature-pressure of the press cycle. A weak narrow section of the seal defines the breaching point of the locking bubble. The locking bubble may be positioned in a corner of the container or along the middle of an edge.

The presence of the trapped air inflates the locking bubble, and maintains the flat sides of the closure valve in the closed state. Prior to the initial use, the consumer "pops" or breaches the locking bubble, releasing the locking pressure. Alternatively, the consumer may snip or cut or manually tear off the corner of the container to deflate the locking bubble to release the locking pressure. The flat sides of the pour channel may then be squeezed into the bowed open state. The container may be tilted toward the horizontal to pour out the product. A projecting pour channel may be employed. The weight of the product flowing into the closed pour channel may separate the flat sides and cause the channel to reopen. The cohesive valve may be manually reclosed between uses. The popped locking bubble remains attached to the container, and does not become a swallowing hazard or general litter.

The pour opening in the pour channel may extend to the ambient, or be inside the locking bubble. The short pour channel extends only to the locking bubble. The container cannot pour until the locking bubble has been edge breached, connecting the pour channel with the ambient. Prior to breach, consumer pressure on the container causes the closure valve to temporarily open. Air (or liquid) from the container escapes through the valve into the locking bubble. This added air pumps-up the locking bubble, increasing the locking pressure inside the locking bubble, further closing the closure valve.

The locking bubble may be edge breached by the pressure of a thumb and forefinger (or any other finger or fingers) on one hand. The product container may be grasped proximate the locking bubble by the consumer, and opened, and poured, all in a single action with a single hand. Alternatively, both hands may be employed.

The inner surfaces of the locking bubble may be coated with an adhesive to permit resecuring of the container after initial use. The adhesive may be any suitable chemical or mechanical adhesive. The resealable cohesive valve eliminates the need for a separate closure device such as a screw cap or lid.

The container may be regular in shape, i.e. a triangle or a quadrangle or other polygon. Alternatively, the container may be irregular in shape, or contoured to allow easy grasping and access to the locking bubble.

Further aspects and features of the present disclosure are discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
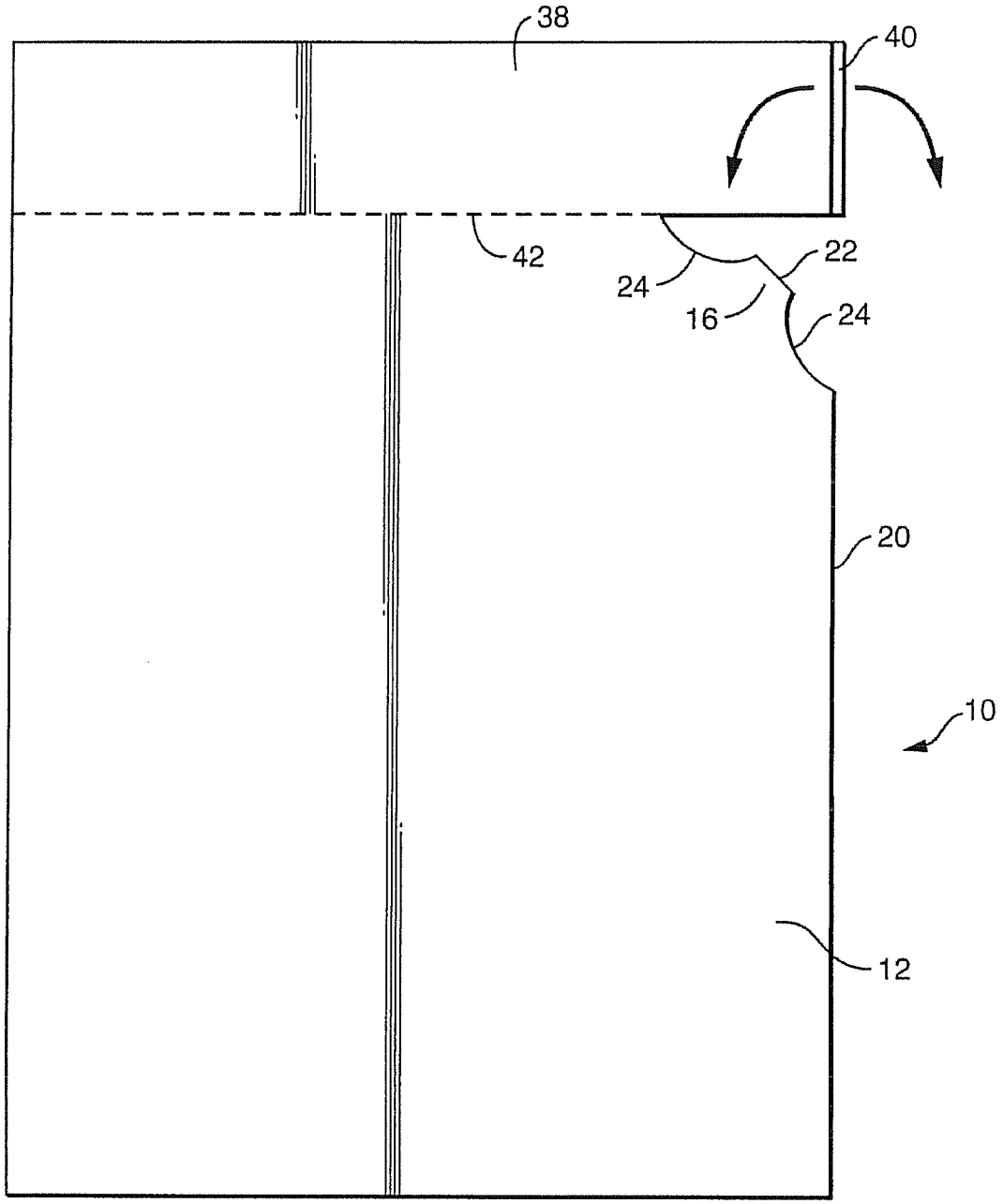
FIGS. 1, 2 and 3 are plan views illustrating the construction of a container made in accordance with the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present invention.

In general, the present disclosure is directed to containers for holding and dispensing compositions that include a built-in pour channel. In accordance with the present disclosure, the pour channel is surrounded and enclosed by a locking bubble. The locking bubble prevents the contents of the container from exiting the pour channel until it is desirable to open the container. In order to open the container, the locking bubble is breached by a user. For instance, in one embodiment, the bubble can be designed to "pop" when squeezed together by the user. Once the locking bubble is breached, the pour channel becomes available for dispensing compositions from the container.

Figure 4:
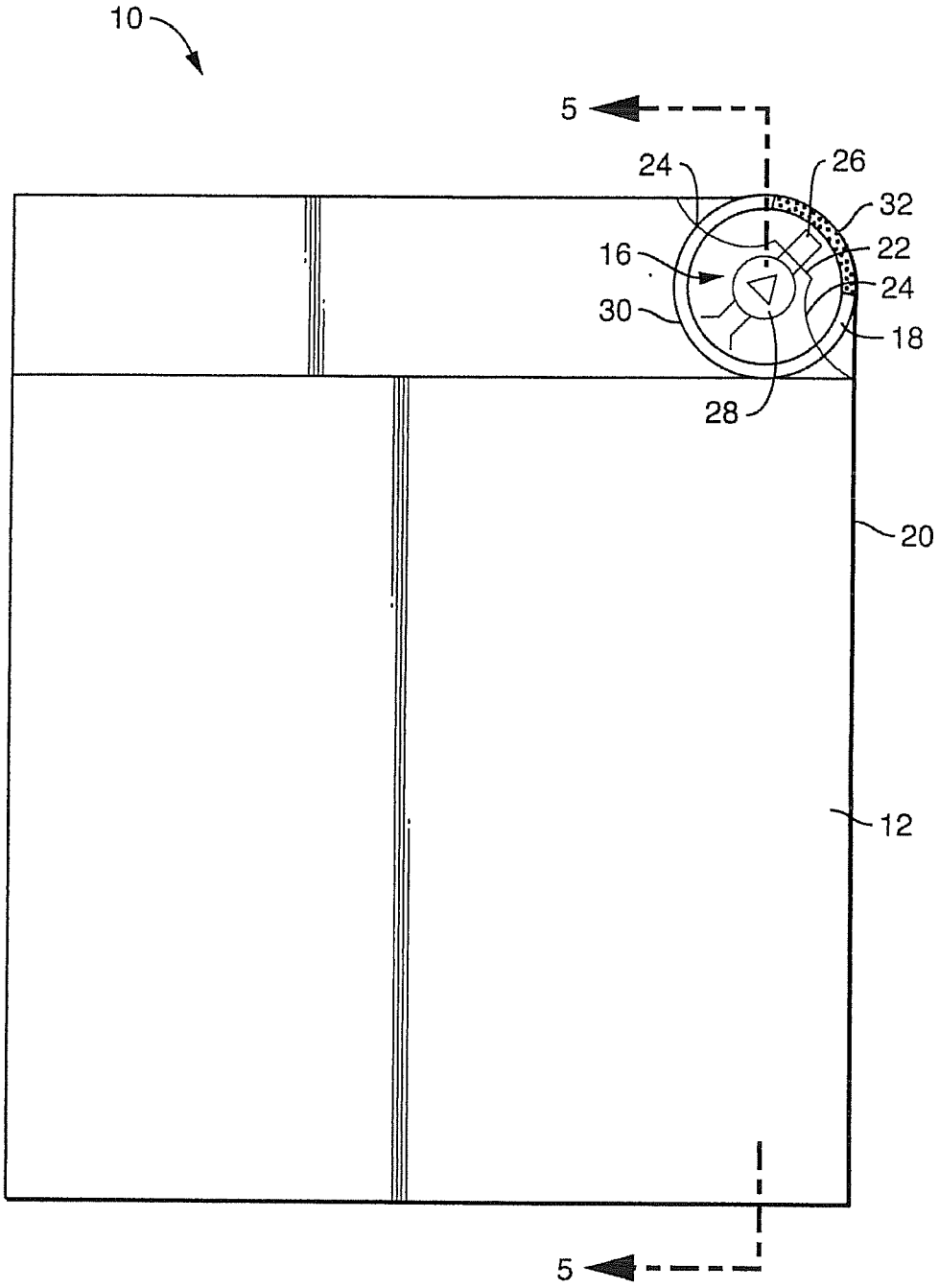
FIG. 4 is a plan view of one embodiment of a container made in accordance with the present disclosure.
Figure 5:
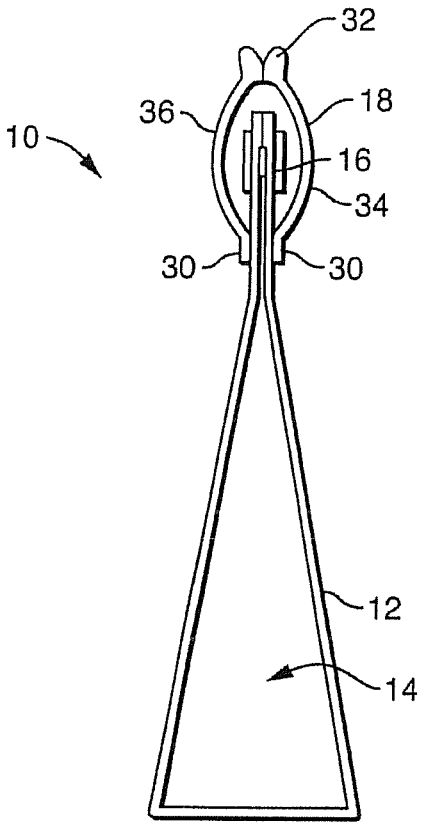
FIG. 5 is a cross-sectional view of the container illustrated in FIG. 4.
Figure 6:
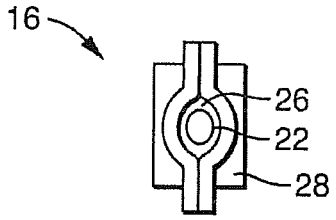
FIG. 6 is a cross-sectional view of the pour channel present on the container in FIG. 4.

Referring to FIGS. 4, 5 and 6, one embodiment of a container 10 made in accordance with the present disclosure is illustrated. As shown particularly in FIG. 5, in this embodiment, the container is in the form of a pouch and includes a container housing 12 defining a hollow interior volume 14. The container 10 can be designed to hold any suitable composition capable of being dispensed from the container through pouring or by squeezing the sides of the container. The composition contained in the container 10, for instance, may be a liquid, a pourable solid such as a powder or granules, a paste, or a gel. Particular products that may be contained in the container include beverages, automotive products such as motor oil, engine additives, antifreeze and the like, liquid soaps and detergents, liquid adhesives, gel-like food products such as yogurt and the like, polishing compositions, and the like. It should be understood that the above list of possible products that may be contained in the container is merely exemplary and is not intended in any way to limit possible applications for the container as illustrated in FIG. 4.

The container housing 12 of the container 10 can be made from any suitable material. For example, in one embodiment, the container housing 12 can be made from flexible materials such as polymer films. Polymers that may be used to form the housing include, for instance, polyesters, polyamides, polyvinyl chloride, polyolefins such as polyethylene and polypropylene, mixtures thereof, copolymers and terpolymers thereof, and the like. When formed from a polymer film, for instance, in one embodiment, the film may be made from multiple polymer layers. The polymer film, for instance, may include a core layer laminated to other functional layers, such as heat sealing layers, oxygen barrier layers, and the like. In one embodiment, for instance, the polymer film may include a metallized layer for providing oxygen barrier properties.

It should be understood, however, that the container 10 as shown in FIG. 4 can also be made from more rigid materials. For instance, the container 10 can also be made from coated paperboard materials and shape-retaining polymers, such as polystyrene, polyesters, polyamides, polyvinyl chloride, polyolefins, polycarbonates, and the like.

As particularly shown in FIG. 4, the container 10 further includes a pore spout 16 located within a locking bubble 18. The pour channel 16 is for dispensing compositions from the container 10. The locking bubble 18 prevents compositions from exiting the container until the bubble is breached as will be described in greater detail below.

As shown, in this particular embodiment, the container housing 12 includes a sealed perimeter 20. The sealed perimeter 20 includes indented sealed edges 24 within the locking bubble 18. The sealed edges 24 terminate at an opening 22. Contained within the opening 22 is a channel member 26 through which the contents of the container exit. The outer surface of the channel member 26 is attached to and sealed around the opening 22 (see FIG. 6).

The channel member 26 can be made from any suitable material. In one embodiment, for instance, the channel member 26 can be a rigid tube. In other embodiments, however, the channel member 26 can be made from flexible polymer films. In still another embodiment, the channel member 26 may be integral with the container housing 12 by bonding opposing sides of the container housing together to form the channel member. When formed from the container housing, the channel member 26 may terminate at the opening 22.

In the embodiment illustrated in FIG. 4, the pour channel 16 further includes a one-way valve 28. The one-way valve may be configured to only permit the contents of the container 10 to exit the container in the forward direction. For example, the one-way valve 28 may be configured to prevent reverse flow of ambient air or other fluids into the container. The one-way valve 28 may be provided to not only assist in dispensing compositions from the container but also to prevent contamination. When the one-way valve 28 is present in the pour channel 16, the volume of the container may progressively decrease as the contents are dispensed.

The construction of the one-way valve 28 may vary depending upon the particular embodiment. For example, the one-way valve may include a flap located within the channel member that only moves in a single direction when fluid pressure within the container is exerted on the flap.

In accordance with the present disclosure, the pour channel 16 is contained within a locking bubble 18. The locking bubble 18 is surrounded by and defined by a bubble seal 30 that is at least partially breachable. For example, the bubble seal 30 can include a breachable point or portion 32 that is located opposite the channel member 26. The breachable point 32 represents a portion of the bubble seal 30 that more easily separates than the remainder of the seal.

The bubble seal 30 can be made using various techniques and methods. For instance, the bubble seal 30 can be made using thermal bonding, ultrasonic bonding, or an adhesive. For instance, in one particular embodiment, the bubble seal 30 can be made by placing a heated sealing bar against the outer periphery of the bubble and exerting heat and pressure so as to form the locking bubble 18. In this embodiment, for instance, the locking bubble 18 can be made from polymer films.

The breachable point 32 of the bubble seal 30 can also be made using different techniques and methods. When using a sealing bar to form the bubble seal 30, for instance, the breachable point can be constructed by varying the pressure, varying the temperature, or varying the time in which the sealing bar is contacted with the materials along the portion of the bubble seal where the breachable point 32 is to exist.

In an alternative embodiment, the bubble seal 30 can comprise a heat sealed portion. The breachable point 32, on the other hand, may comprise a "peel seal" portion. In this embodiment, for instance, when the locking bubble 18 is breached along the breachable point 32, a small opening may be formed along the bubble seal 30. The breached portion of the bubble seal can form two tabs that can be grasped by a user for further breaching the locking bubble. In this manner, the opening of the bubble can be increased in size to a user's preference.

Various different methods and techniques are used to form peel seal portions. For example, in one embodiment, the breachable point 32 of the bubble seal 30 may include a first portion that is adhesively secured to a second portion along the seal. The first portion of the breachable point may be coated with a pressure sensitive adhesive. The adhesive may comprise, for instance, any suitable adhesive, such as an acrylate.

The second and opposing portion of the peel seal, on the other hand, may comprise a film coated or laminated to a release layer. The release layer may comprise, for instance, a silicone.

When using an adhesive layer opposite a release layer as described above, the breachable point 32 of the bubble seal 30 is resealable after the bubble is breached.

In an alternative embodiment, each opposing portion of the breachable point 32 of the bubble seal 30 may comprise a multi-layered film. The major layers of the film may comprise a supporting layer, a pressure sensitive adhesive component, and a thin contact layer. In this embodiment, the two portions of the breachable point 32 can be brought together and attached. For instance, the thin contact layer of one portion can be attached to the thin contact layer of the opposing portion using heat and/or pressure. When the locking bubble 18 is breached, and the breachable point 32 of the bubble seal 30 is peeled apart, a part of the sealed area of one of the contact layers tears away from its pressure sensitive adhesive component and remains adhered to the opposing contact layer. Thereafter, resealing can be affected by re-engaging this torn away contact portion with the pressure sensitive adhesive from which it was separated when the layers were peeled apart.

In this embodiment, the contact layer can comprise a film having a relatively low tensile strength and having a relatively low elongation at break. Examples of such materials include polyolefins such as polyethylenes, copolymers of ethylene and ethylenically unsaturated comonomers, copolymers of an olefin and an ethylenically unsaturated monocarboxylic acid, and the like. The pressure sensitive adhesive contained within the layers, on the other hand, may be of the hot-melt variety or otherwise responsive to heat and/or pressure.

In still another embodiment, the breachable point 32 of the bubble seal 30 can include a combination of heat sealing and adhesive sealing. For instance, in one embodiment, the breachable point 32 may comprise a first portion that is heat sealed to a second portion. Along the breachable point, however, may also exist a peel seal composition that may, in one embodiment, interfere with the heat sealing process of the bubble seal to produce a breachable portion. The peel seal composition, for instance, may comprise a lacquer that forms a weak portion along the bubble seal.

In an alternative embodiment, an adhesive may be spot coated over the length of the breachable point. Once the breachable point is breached, the adhesive can then be used to reseal the two portions together after use.

Referring to FIG. 5, a cross-sectional view of the container 10 is illustrated. As shown, the pour channel 16 is located within the locking bubble 18. The locking bubble 18 can be formed around the pour channel 16 in any suitable configuration. In the embodiment illustrated, the locking bubble 18 includes a first portion 34 opposite a second portion 36. Referring to FIG. 4 and FIG. 5, the first portion 34 and the second portion 36 both overlap the container housing 12 along a portion of the circumference. Thus, as shown in FIG. 5, the bubble seal 30 is formed in certain places by attaching the first portion 34 and the second portion 36 to the container housing 12 and formed in other portions by directly attaching the first portion 34 to the second portion 36. As shown in FIG. 4, the breachable point 32 can be located where the first portion 34 directly attaches to the second portion 36. In other embodiments, however, the breachable point 32 can be located in between one of the first or second portions and the container housing.

The locking bubble 18 is filled with a gas, such as air. As shown in FIG. 4, the interior volume of the locking bubble 18 is generally in fluid communication with the pour channel 16. In order to prevent any of the composition contained within the interior volume of the container 10 from spilling or leaking into the interior volume of the locking bubble 18, the gas pressure within the bubble can be sufficient so as to prevent the contents of the container from exiting through the pour channel 16 until the locking bubble is breached. In this manner, the contents of the container are also substantially prevented from spilling out of the container when the package is opened by the consumer.

The locking bubble 18, as described above, is expandable to open the container 10 by external pressure applied by a consumer. For small bubbles, the consumer may simply pinch a bubble or bubbles between his thumb and forefinger. Slightly larger bubbles may require thumb-to-thumb pressure. Pressure can also be applied to the bubble by placing the bubble against a flat surface and applying pressure with one's fingers or palm.

When pressure is applied to the locking bubble 18, the atmosphere within the bubble applies pressure to the bubble seal 30 which causes the bubble to breach at the weakest portion. For instance, in embodiments that include a breachable point 32, separation of the bubble occurs along the breachable point creating an edge breach. The edge breach may be sufficient to allow access to the pour channel 16 for dispensing the contents of the container. Alternatively, the edge breach may form flaps that can be easily peeled apart for better exposing the pour channel 16.

In the embodiment illustrated in FIG. 4, the locking bubble 18 has a circular shape. It should be understood, however, that the locking bubble can have any suitable shape. For example, in other embodiments, the locking bubble may have an oval shape, may be triangular, may have a heart-like shape, may have a rectangular-like shape, or may have a more complex configuration. Further, in addition to being located only in the corner of the container 10, the locking bubble may extend substantially along the length of the top portion of the package. Thus, the size of the locking bubble may be increased in certain applications.

In addition to the perimeter shape of the locking bubble 18, the locking bubble may also have different 3-dimensional shapes. For instance, in the embodiment illustrated, the locking bubble 18 includes two opposing lobes that extend outwardly from each side of the container housing. In an alternative embodiment, however, the locking bubble 18 may only include a single lobe projecting from only one side of the container housing.

The manner in which the locking bubble 18 is formed on the container 10 can vary depending upon the particular application and the desired result. In one embodiment, for instance, the first portion 34 and the second portion 36 of the locking bubble 18 can be placed over the pour channel 16 and sealed into place while incorporating an appropriate atmosphere within the bubble.

In an alternative embodiment, the locking bubble 18 can be integral with the container housing 12 in that the bubble can be made from the same films that are used to form the container. For example, referring to FIGS. 1-3, one embodiment of a method for forming the locking bubble 18 is illustrated. Like reference numerals have been used to indicate similar elements.

Figure 2:
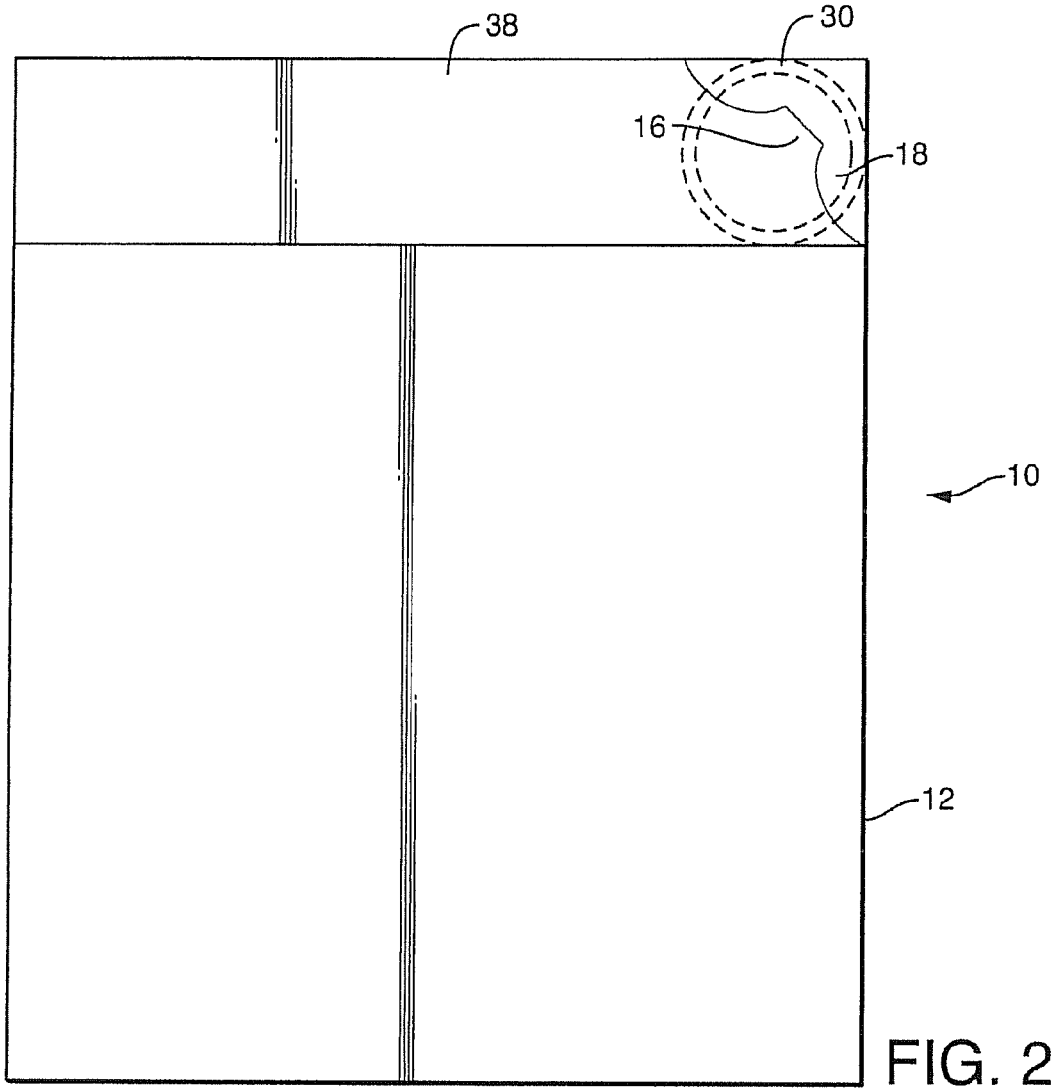

As shown in FIG. 1, a partially constructed container 10 in accordance with the present disclosure is shown. The container 10 includes a container housing 12 made from opposing polymer films. The container housing 12 includes a sealed perimeter 20 that includes sealed edges 24 and an opening 22. The opening 22 forms a pour channel 16.

Figure 3:
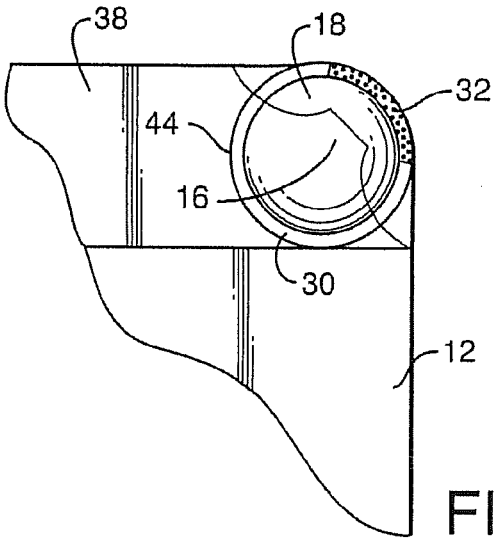

As shown, the container housing 12 includes two opposing flaps 38 and 40 that extend above the pour channel 16. In order to form the locking bubble 18, the flaps are folded along the dotted line 42 to arrive at the configuration shown in FIG. 2. Next, the locking bubble 18 can be formed by forming a bubble seal 30 that circumscribes the bubble. The bubble seal 30 can be formed using any of the techniques described above. For example, as shown in FIG. 3, in one embodiment, the bubble seal 30 can include a permanently sealed portion 44 and a breachable portion 32. The permanently sealed portion 44 can be formed by thermally bonding the flaps together in certain areas and by thermally bonding the flaps to the container housing 12 in other areas. The bubble seal 30 can further include the breachable portion 32 which, in one embodiment, may comprise a peel seal.

Figure 7:
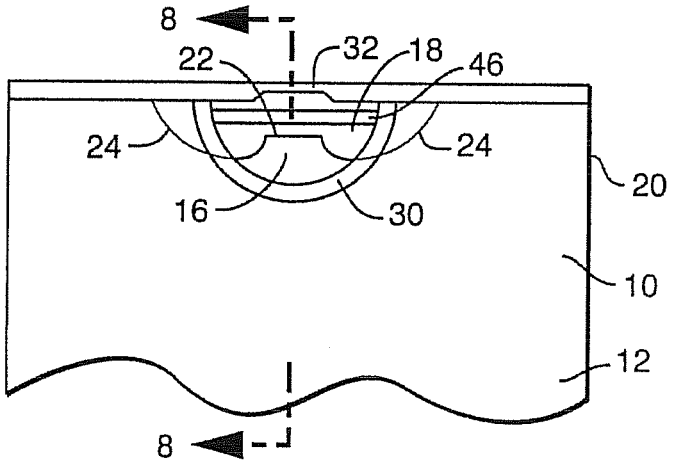
FIG. 7 is a plan view with cutaway portions of another embodiment of a locking bubble and pour channel for a container made in accordance with the present disclosure.
Figure 8:
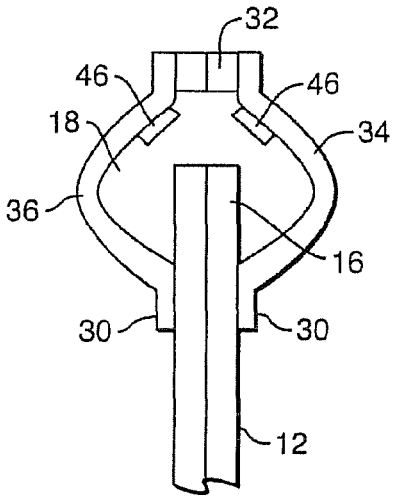
FIG. 8 is a cross-sectional view of the embodiment illustrated in FIG. 7.

Referring to FIGS. 7 and 8, another embodiment of a container 10 made in accordance with the present disclosure is illustrated. Like reference numerals have been used to indicate similar elements. As shown in FIG. 7, the container 10 includes a container housing 12 defined by a perimeter 20. The perimeter 20 includes sealed edges 24 that define an opening 22. The opening 22 forms a pour channel 16. In this embodiment, the pour channel 16 is located generally in the middle in the top of the container as opposed to being located in a corner of the container as shown in FIGS. 3 and 4.

As illustrated in FIG. 7, instead of having a round shape, the locking bubble 18 has a semi-circular profile. As shown, the locking bubble 18 is defined by a bubble seal 30, which includes a breachable point 32 where the bubble breaches when pressure is applied. The breachable point 32 is located opposite the opening 22 of the pour channel 16.

Referring to FIG. 8, a cross-sectional view of the pour channel 16 in the locking bubble 18 are illustrated. As shown, the locking bubble 18 includes a first portion 34 attached to a second portion 36.

In the embodiments illustrated in FIGS. 7 and 8, the locking bubble 18 further includes an adhesive portion 46 located on the inside of the bubble. The adhesive portion 46 is present in the bubble in order to reseal the locking bubble 18 and the container 12 once the locking bubble is breached. Any suitable adhesive may be applied to the inside surface of the bubble. In one embodiment, for instance, an adhesive may be used that only sticks to itself. Thus, two different adhesive strips can be positioned on opposite sides of the bubble. In other embodiments, however, an adhesive may be applied to only one side of a bubble for adhering to the opposite side.

Figure 9:
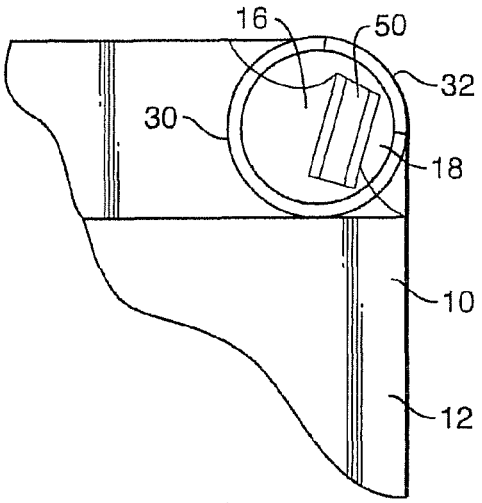
FIG. 9 is a plan view with cutaway portions of another embodiment of a container made in accordance with the present disclosure.

Referring to FIG. 9, still another embodiment of a container 10 made in accordance with the present disclosure is illustrated. Once again, like reference numerals have been used to indicate similar elements. In the embodiment illustrated in FIG. 9, the container 10 includes a container housing 12 that is in communication with a pour channel 16. The pour channel 16 is contained within a locking bubble 18 defined by a bubble seal 30. The bubble seal 30 includes a breachable point or portion 32 located opposite the pour channel 16.

In the embodiment illustrated in FIG. 9, the pour channel 16 includes an extended portion 50 that is folded within the locking bubble 18. The extended portion 50 can be integral with the film layers used to form the container housing or can be a separate component that is attached to the container housing at an opening. The extended portion 50 generally defines a channel therein for dispensing the contents of the container.

Once the locking bubble 18 is breached, a user can remove the extended portion 50 from the locking bubble 18 in order to more easily dispense the contents of the container. In particular, the extended portion 50 can extend beyond the perimeter of the locking bubble so that the contents of the container can be dispensed without the bubble interfering. In one embodiment, the extended portion 50 can be placed in fluid communication with a straw that extends to the bottom of the container. In this manner, the extended portion 50 can be used with the straw to allow a user to drink from the container, should the container contain a beverage or food product.

Figure 10:
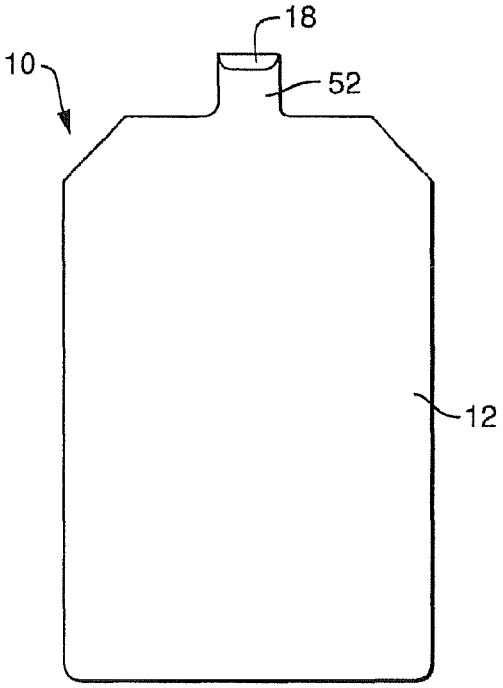
FIG. 10 is a plan view of still another embodiment of a container made in accordance with the present disclosure.
Figure 11:
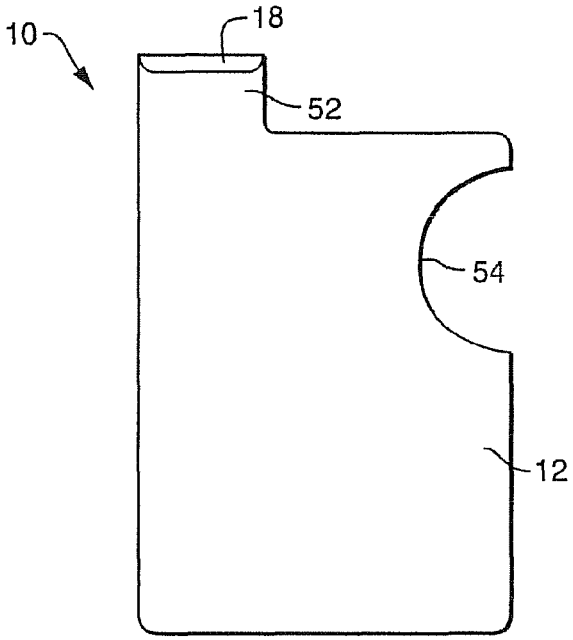
FIG. 11 is a plan view of still another embodiment of a container made in accordance with the present disclosure.
Figure 12A:
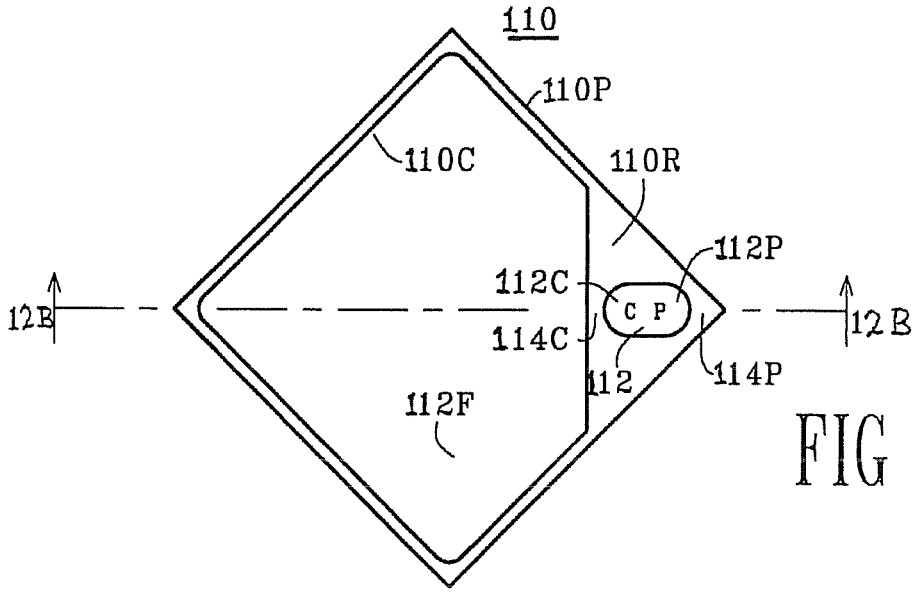
FIG. 12A shows apparatus 110 with storage chamber 110C, chamber access region 110R, and corner conduit 112.
Figure 12B:
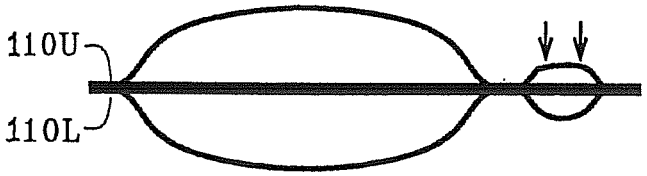
FIG. 12B is a cross-sectional view of apparatus 110 of FIG. 12A taken generally along reference line 12B thereof, showing apparatus 110 prior to breaching.
Figure 12C:
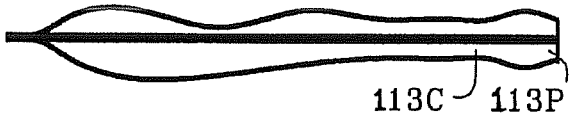
FIG. 12C is a cross-sectional view of apparatus 110 of FIG. 12D taken generally along reference line 12C thereof; after breaching showing perimeter breach 113P.
Figure 12D:
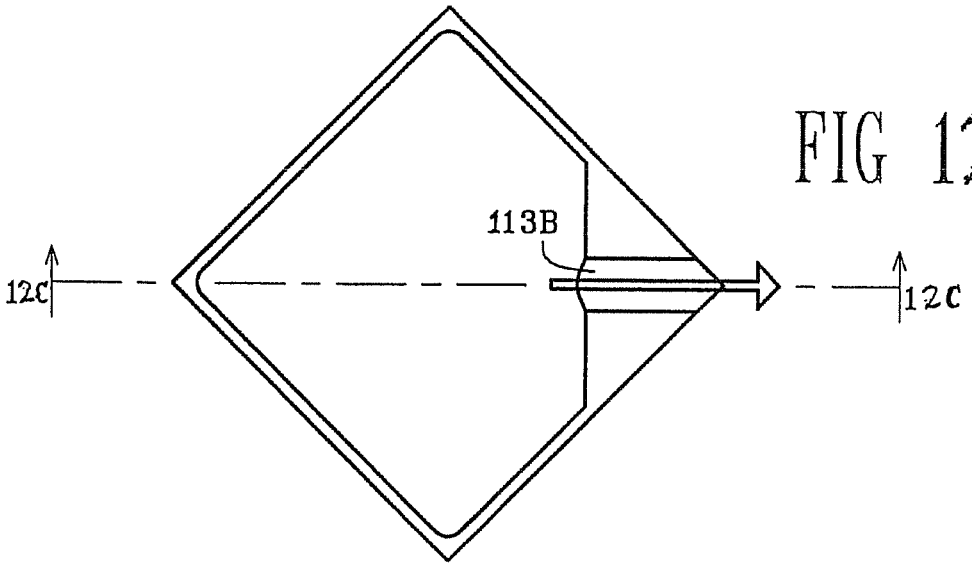
FIG. 12D shows apparatus 110 after breaching with breached corner conduit 112 discharging stored fluid 112F from storage chamber 110C into the ambient.

It should be understood that containers made according to the present disclosure can have any suitable shape and configuration. As described above, the containers can be made from flexible polymer films or can be made from rigid materials. Referring to FIGS. 10 and 11, other possible configurations of containers made in accordance with the present invention are shown. In FIG. 11, the container 10 includes a container housing 12 in communication with a neck portion 52. At the end of the neck portion 52 is a locking bubble 18 that, once breached, allows for the contents of the container to be dispensed through a pour channel. In the embodiment illustrated in FIG. 10, the locking bubble 18 has a rectangular shape with rounded corners.

Another configuration of a container 10 in accordance with the present disclosure is illustrated in FIG. 11. In FIG. 11, the container 10 includes an indentation 54 which may be used to grasp and handle the container. The container 10 also includes a neck portion 52 terminating at a locking bubble 18.

Referring now to FIGS. 12-20, further embodiments of containers made in accordance with the present disclosure are illustrated. For instance, referring to FIGS. 12A, 12B, 12C and 12D, an apparatus 110 is shown that has a breachable flow conduit 112 for discharging stored fluid 112F contained in storage chamber 110C out to the ambient. The apparatus may be formed by upper lamina 110U and lower lamina 110L pressed into a sealing engagement to form bubble type flow conduits. Chamber access region 11OR is positioned proximate perimeter 110P of the apparatus. The breachable flow conduit is within the access region, and has an inner end 112C proximate the storage chamber and an outer end 112P proximate the perimeter of the apparatus. The flow conduit has outer pressed seal 114P between the outer end of the flow conduit and the perimeter of the apparatus. The flow conduit also has inner pressed seal 114C between the inner end of the flow conduit and the edge of the storage chamber. The flow conduit expands towards the perimeter of the apparatus under external pressure, typically applied by the consumer. The pressure separates the opposed laminae until the flow conduit breaches at the perimeter of the apparatus creating a perimeter breach 113P from the flow conduit into the ambient through the outer seal. The flow conduit also expands towards the storage chamber under the applied pressure. The pressure separates the opposed laminae until the flow conduit breaches at the edge of the storage chamber creating a chamber breach 113C from the flow conduit into the storage chamber through the inner seal (see FIGS. 12C and 12D). The double breached flow conduit 113B establishes fluid communication between the storage chamber and the ambient for discharge of the stored fluid.

The flow conduit may be elongated, extending across the access region from the perimeter of the apparatus to the edge of the storage chamber. The flow drag along the sides of the conduit urges the flowing fluid into a laminar flow with minimal turbulence. The discharged fluid flows out of the conduit in a stream that can be directed.

The entire apparatus including both the storage chamber and the access region may be formed by the opposed laminae pressed into sealing engagement, which simplifies manufacture. Alternatively, only the access region, or just the flow conduit, may be formed by the pressed lamina material. The storage chamber may be formed of different material, avoiding long standing exposure of the stored fluid with the laminae material. The lamina material may be any suitable material such as plastic, paper (with wood and/or cotton content) fabric, cellophane, or biodegradable matter. A thin web made of materials such as mylar or plastic or aluminum, forms a flexible film with hermetic properties, and is commonly used as a tear-resistant packaging material.

The stored fluid may be any flowable liquid, syrup, slurry, dispersion, or the like. Low viscous fluids will flow under gravity downward out the storage chamber through the breached conduit out to the ambient. Higher viscous fluids may be squeezed out of a flexible bag chamber and through a breached conduit, like toothpaste. In addition, the stored fluid may be any pourable powder such as sugar, salt, medications, or the like, that can pass through the flow conduit. The particles of the powder roll, slide, cascade and tumble past each other in a fluid manner. Some powders may require a tap or shake of the apparatus in addition to gravity for discharge from the storage chamber.

The flow conduit is expandable by external pressure applied by a consumer, to establish fluid communication from the chamber out to the ambient. The inner and outer seals may be breached separately by pressing twice, once at each end of the conduit. Alternatively, these seals may be breached simultaneously by pressing once in the center of conduit. For small conduits, the consumer may simply pinch the conduit or conduits between his thumb and finger. Slightly larger conduits may require thumb pressure against a hard surface such as a table. The consumer may direct the conduit expansion outward towards the ambient at perimeter 110P of the apparatus by applying pressure along outer end 112P of flow conduit 112 proximate point "P" (see FIG. 12A). The consumer may also direct the conduit expansion inward towards storage chamber 110C by applying pressure along inner end 112C of the conduit proximate point C.

The outward expansion of the conduit progressively separates the opposed laminae of outer seal 114P, along a moving separation frontier. The frontier moves across the outer seal until the frontier reaches the perimeter of the apparatus, where the conduit breaches creating perimeter breach 113P (see FIG. 12C). The inward conduit expansion separates the opposed laminae of inner seal 114C, along a similar moving separation frontier. The fluid in the conduit is forced away from the point of pressure toward the seals, which causes the separation of the seals. The conduit fluid is preferably a compressible gas, but may be any suitable liquid. The conduit gas is compressed by the applied pressure creating an expansive force. The outer seal may be resealable after perimeter breaching for resealing the apparatus.

The inner seal may be stronger than the outer seal due to a higher temperature and/or pressure and/or dwell-time during seal formation. That is, the inner seal may be fused together more than the outer seal. The outer seal may be breached first forcing conduit gas into the ambient. As the inner seal is breached, the conduit is pressed closed, preventing the loss of any stored fluid.

Figure 13:
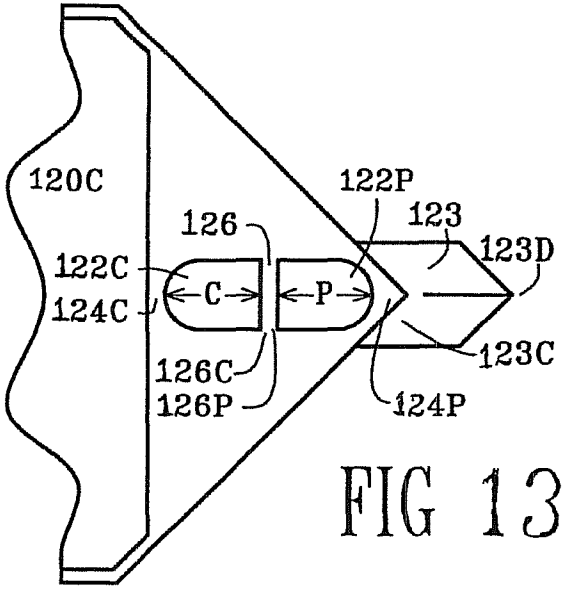
FIG. 13 shows a flow conduit divided by barricade dam 126, and with discharge chute 123.

Barricade Dam—(FIG. 13)

The flow conduit may have a barricade dam which presents additional pressed seal type barriers between the ambient and the chamber containing the stored fluid. In the embodiment of FIG. 13, barricade dam 126 is provided across the flow conduit, for dividing the flow conduit into an inner conduit section 122C proximate storage chamber 120C, and an outer conduit section 122P proximate the perimeter. The barricade has inner barrier wall 126C facing the inner conduit section, and outer barrier wall 126P facing the outer conduit section. The inner conduit section is expandable by applying pressure at point C. The expansion is inward toward inner seal 124C and storage chamber 120C, and also outward toward inner barrier wall 126C of the barricade. The outer conduit section is also expandable by applying external pressure at point C. The expansion is outward toward outer seal 124P and ambient, and also inward toward outer barrier wall 126P of the barricade. The expanding conduits merge into one another creating a barricade breach which eliminates the barricade dam. The expansion continues under applied pressure until the inner conduit chamber breaches into the storage chamber and the outer conduit perimeter breaches out to the ambient. The three breaches, the barricade breach and the chamber breach and the perimeter breach, establish fluid communication from the storage chamber to the ambient, permitting the discharge of the stored fluid. The three breach requirement reduces the possibility of accidental releases.

Figure 15:
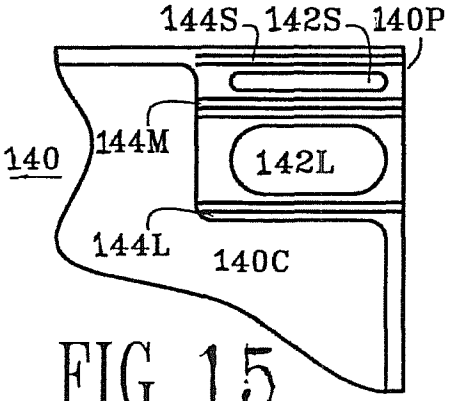
FIG. 15 shows multiple flow conduits 142S and 142L having different widths.
Figure 14:
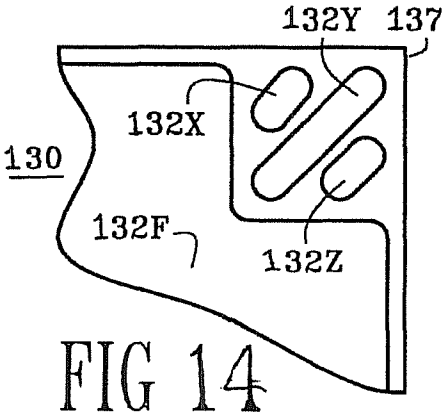
FIG. 14 shows multiple flow conduits 132X and 132Y and 132Z having the same width.

Multiple Conduits—(FIGS. 14 and 15)

The apparatus may have multiple flow conduits for providing multiple breaches establishing multiple fluid communications between the storage chamber and the ambient for multiple discharge flows of the stored fluid. Apparatus 130 has three flow conduits, 132X, 132Y and 132Z (see FIG. 14) which provide faster discharge of stored fluid 132F. The consumer may control the discharge flow rate. A single conduit may be breached for a slow flow, and additional conduits may be breached for higher flow rates. In the embodiment of FIG. 14, the multiple flow conduits have the same width and the same flow rates, for providing equal increases in the flow capacity.

Alternatively, multiple flow conduits may have different widths for providing multiple breached flow conduits with different flow capacities. Apparatus 140 has small flow conduit 142S and large flow conduit 142L (see FIG. 15) to provide small and large flow rates. An extra large flow rate may be provided by breaching both of the flow conduits. The small flow rate from the breach of small conduit 142S combines with the large flow rate from the breach of large conduit 142L to provide an extra large flow.

Figure 16:
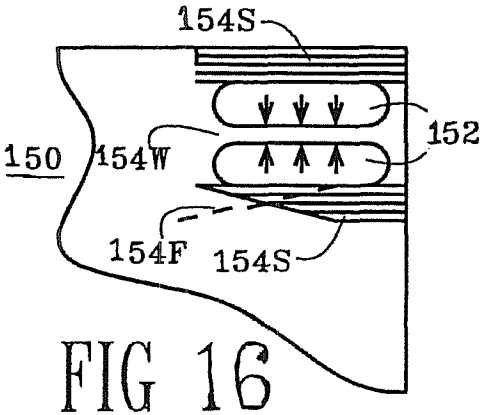
FIG. 16 shown adjacent narrow conduits 152 which laterally expand to merge into a single wide conduit.

Lateral Expansion—(FIGS. 15 and 16)

The expanding flow conduits may be prevented from lateral expansion during the applied pressure by strong lateral seals. The lateral seals preferably extend along the side of the elongated flow conduits from the storage chamber to the ambient. Apparatus 140 has three lateral seals, 144S and 144L and 144M (indicated by solid parallel lines). Lateral seal 144S prevents small flow conduit 142S from expanding into perimeter 140P causing a long and random perimeter breach. Lateral seal 144L prevents large flow conduit 142L from expanding into chamber 140C causing a long and random chamber breach. Middle lateral seal 144M located between the small and large flow conduits prevents the conduits from expanding into one another. The three lateral seals offer stiff resistance to lateral expansion, directing the pressure force within the flow conduits to cause expansion at the ends. Therefore, expansion due to the directed pressure is primarily outward towards the perimeter of the apparatus, and inward towards the chamber. The lateral seals may be stronger than either the inner seal or the outer seal due to a higher temperature and/or pressure and/or dwell-time during seal formation.

Alternatively, the lateral seals may be weak (soft) to permit lateral expansion during the applied pressure. Apparatus 150 (see FIG. 16) has flow conduits 152 with two strong outside lateral seals, 154S (indicated by parallel solid lines) and one weak internal lateral seal 154W. Weak lateral seal 154W is located between flow conduits 152 and permits lateral expansion of the conduits, which merge into one another forming a single larger conduit. The single larger conduit has a flow capacity greater than the sum of the two original conduits. For example, the two original flow conduits 152 each have a diameter of 6 mm and a flow cross-sectional area of approximately 28 square mm. The total original flow area is 56 square mm. The merged conduit has a diameter of 14 mm (6 mm plus 6 mm plus 2 mm for middle seal 154W) and a flow cross-section of approximately 154 square mm. The two mm of lateral merging increased the flow capacity by almost three times. The lower outside lateral seal 154S may become progressively weaker near the storage chamber to permit limited progressive lateral expansion and widening of conduit 152 near the storage chamber to form discharge funnel 154F (shown as dashed lines).

The access region within the apparatus may be located at a corner or between corners. Apparatus 130 has at least one corner 137, and the flow conduits positioned proximate that corner (see FIG. 14). The corner breach provided at the corner location facilitates the discharge of the stored fluid. Alternatively, the apparatus two corners or more, and the access region may be located proximate the middle between two corners. Apparatus 160 has at least two corners 167 (see FIG. 17), with flow conduit 162D positioned between the two corners.

Figure 17:
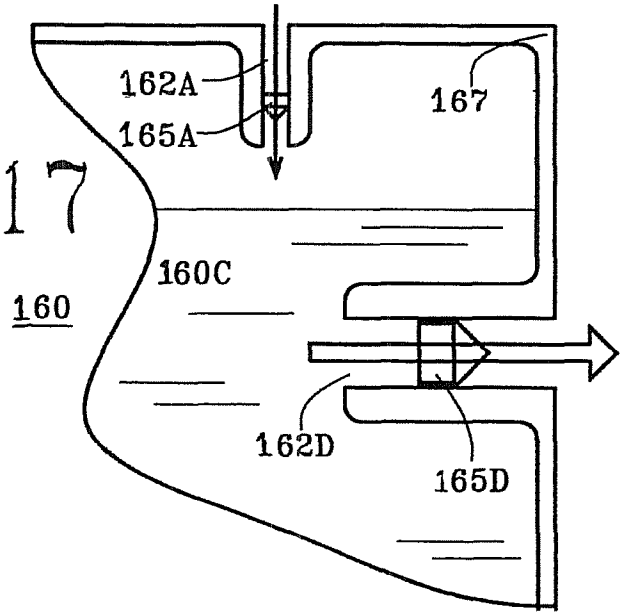
FIG. 17 shows out-only valve 165D positioned in discharge conduit 162D, and in-only valve 165A positioned in air intake conduit 162A.

Flow Valves—(FIG. 17)

In some applications ambient air must be kept out of the storage chamber. Apparatus 160 has out-only flow valve 165D positioned in flow conduit 162D (see FIG. 17) for preventing the entry of ambient atmosphere into storage chamber 160C. The storage chamber may be flexible as shown in FIG. 12 or rigid as shown in FIG. 17. Flexible storage chamber 110C collapses as the stored fluid is discharged. Ambient air does not enter the storage chamber. Further, flexible chambers are light-weight and may be crushed, rolled or wadded-up into a small size and easily discarded or recycled. The wadded up flexible chambers do not have lids, caps, tabs and other tiny closure gadget which are hazardous to children and animals. Rigid storage chamber 160C is formed by a rigid, self-standing material, and cannot collapse as the chamber empties. Outside air must enter the storage chamber to replace the discharged fluid, or else a partial vacuum may develop in the chamber which inhibits discharge flow. Small air intake conduit 162A provides fluid communication between the rigid storage chamber and the ambient. The intake conduit permits the flow of replacement air into the chamber to replace the volume of storage fluid that was discharged out through breached flow conduit 162D. In-only air intake valve 165A is positioned in the air intake conduit to prevent stored fluid from escaping.

Figure 19:
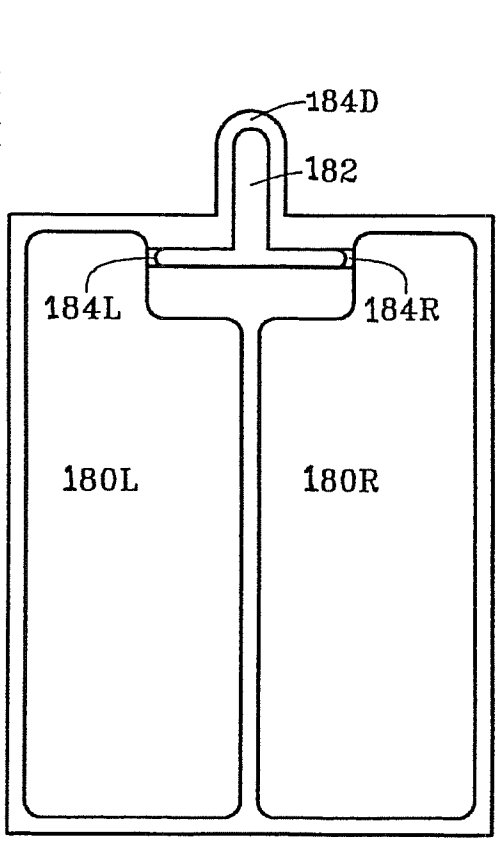
FIG. 19 shows multiple storage chambers 180L and 180R with common discharge conduit 182.
Figure 18:
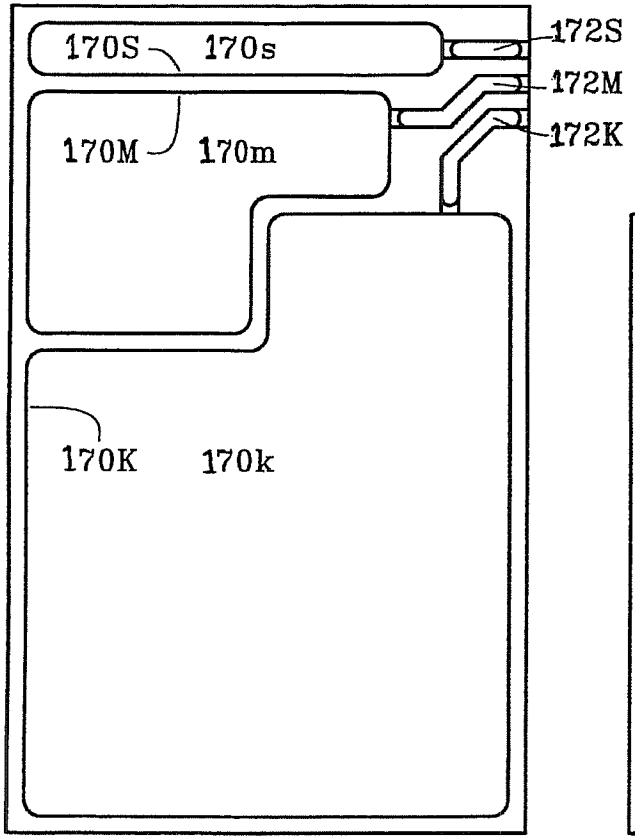
FIG. 18 shows multiple storage chambers 170K and 170M and 170S, each with a flow conduit 172K and 172M and 172S.

Multiple Chambers—(FIGS. 18 and 19)

The flow conduit apparatus may have multiple storage chambers for storing multiple fluids. In a three chamber embodiment (FIG. 18), apparatus 170 has first chamber 170K, which may be large for holding a primary fluid, for example coffee 172K. Primary flow conduit 172K extends from the main chamber to the ambient, and provides fluid communication therebetween when breached. Second chamber 170M may be smaller and hold a secondary fluid, for example milk 172M. Secondary flow conduit 172M extends from the second chamber to the ambient. Third chamber 170S may be even smaller and hold a tertiary fluid, for example a sweetener 172S. Tertiary flow conduit 172S extends from the third chamber to the ambient. The consumer may access the stored fluids separately or all together. For example, in the coffee embodiment, a consumer who wants black coffee breaches only primary flow conduit 172K to release the coffee from chamber 170K. A consumer who drinks coffee with cream breaches both primary flow conduit 172K and secondary conduit 172M to release the coffee from chamber 170K and the milk from chamber 170M. A consumer who drinks coffee with cream and sugar must breach all three flow conduits.

Alternatively, in some embodiments multiple stored fluids may be accessed simultaneously. Apparatus 180 has two storage chambers 180L and 180R (see FIG. 19), connected to "T" flow conduit 182 through left inner seal 184L and right inner seal 184R. The "T" flow conduit connects to the ambient through to common outer seal 184P. Breaching the three seals 184L and 184R and 184P, permits both fluids to discharge simultaneously.

Discharge Spouts—(FIGS. 13 and 19)

The apparatus may have a discharge spout extending from the breached flow conduit for guiding the discharge of the stored fluid. Discharge spout 123 (see FIG. 13) is an open chute having a conduit end 123C and a discharge end 123D. The spout projects from the flow conduit at the conduit end and guides the discharge at the discharge end. At least the discharge end of the discharge spout may be formed of semi-rigid material which may be bent and shaped to steer the discharge. Alternatively, the discharge spout may be a covered tube for guiding the discharge. Discharge spout 183 (see FIG. 19) is formed by opposed lamina pressed together. Outer seal 184 of the flow conduit is at the discharge end of the discharge spout.

Figure 20B:
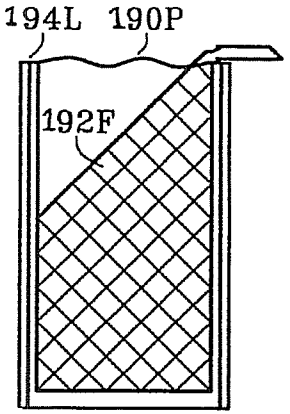
FIGS. 20A and 20B show flow conduit 192 breached along the entire end of storage chamber 190C.
Figure 20A:
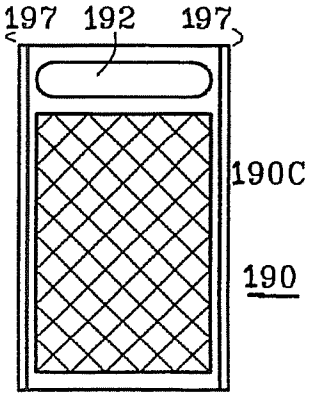

End Opening Embodiment—(FIGS. 20A and 20B)

The flow conduit may extend across the entire width of the apparatus to provide a large breach for quickly discharging the stored fluid. Apparatus 190 has flow conduit 192 which extends between end corners 197 (See FIG. 20A), occupying the entire width of apparatus 190. Perimeter breach 190P (see FIG. 20B) also extends the entire width between the two corners creating an end opening in the apparatus. The entire end of the apparatus becomes a discharge opening. Strong lateral seals 194L (indicated by solid parallel lines) may be employed to prevent lateral breaches and undirected lateral discharge. Stored fluid 192F, including powders (indicated by cross-hatching), may be easily discharged out the end opening of the apparatus.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A container for holding and dispensing compositions comprising:

a container housing defining a hollow interior volume and comprising at least one sealed edge;

a pour channel in communication with the interior volume of the container housing; and a locking bubble surrounding the pour channel wherein the entire pour channel is contained within the locking bubble, the locking bubble being surrounded by a bubble seal, the bubble seal preventing contents contained in the interior volume of the container housing from exiting the container through the pour channel, the locking bubble being breachable when subjected to sufficient pressure, and wherein, when the bubble is breached, the contents of the container can be dispensed through the pour channel, wherein at least one sealed edge of the container housing is contained within the locking bubble.

2. A container as defined in claim 1, wherein the bubble seal includes a breaching point comprising a weakened portion of the seal and wherein the locking bubble breaches along the breaching point when sufficient pressure is applied to the bubble.

3. A container as defined in claim 1, wherein the locking bubble includes an interior surface comprising a first portion opposite a second portion, the locking bubble further including an adhesive located on the interior surface that adheres the first portion to the second portion after the locking bubble is breached and the first portion and second portion are pressed together.

4. A container as defined in claim 3, wherein the adhesive comprises a chemical adhesive.

5. A container as defined in claim 3, wherein the adhesive comprises a mechanical adhesive.

6. A container as defined in claim 1, wherein the pour channel extends through the locking bubble.

7. A container as defined in claim 6, wherein the pour channel comprises a channel and wherein the bubble seal extends through the channel where the locking bubble intersects with the pour channel, the breaching point of the breachable seal being located within the channel.

8. A container as defined in claim 1, wherein the locking bubble and the pour channel are integral with the container housing.

9. A container as defined in claim 8, wherein the container housing, the locking bubble and the pour channel are formed from a polymer film.

10. A container as defined in claim 1, wherein the pour channel and locking bubble are located at a corner of the container housing.

11. A container as defined in claim 1, wherein the container housing includes a first end and a second and opposite end, the pour channel and the locking bubble being located approximately mid-center of the first end of the container housing.

12. A container as defined in claim 1, wherein the container housing includes a perimeter, the pour channel comprising a channel that projects from the perimeter.

13. A container as defined in claim 1, wherein the pour channel includes a one-way valve that permits compositions to only exit the container housing.

14. A container as defined in claim 1, wherein the container housing contains a composition and wherein the locking bubble is in communication with an open free end of the pour channel, the container further including a gas being present in between the composition contained in the container housing and the locking bubble, the gas being present at a sufficient pressure to prevent the composition from entering the locking bubble through the pour channel until the locking bubble is breached.

15. A container as defined in claim 9, wherein the locking bubble is formed by a fold along one end of the container housing.

16. A container as defined in claim 15, wherein the fold covers the pour channel.

17. A container as defined in claim 1, wherein, once the locking bubble is breached, the bubble is resealable.

18. The apparatus of claim 1, wherein the bubble seal comprises a perimeter and wherein the entire perimeter is a single, continuous unit.

* * * * *